US007513807B2

(12) United States Patent
Kinoshita et al.

(10) Patent No.: US 7,513,807 B2
(45) Date of Patent: Apr. 7, 2009

(54) OPERATION CONTROL SYSTEM FOR PLANING BOAT

(75) Inventors: Yoshimasa Kinoshita, Shizuoka-ken (JP); Sumihiro Takashima, Shizuoka-ken (JP); Shu Akuzawa, Shizuoka-ken (JP); Kazumasa Ito, Shizuoka-ken (JP); Toshiyuki Hattori, Shizuoka-ken (JP); Fujino Kenichi, Shizuoka-ken (JP); Yoshida Tatsuya, Shizuoka-ken (JP); Suzuki Masaru, Shizuoka-ken (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/451,904

(22) Filed: Jun. 12, 2006

(65) Prior Publication Data

US 2007/0021015 A1 Jan. 25, 2007

Related U.S. Application Data

(63) Continuation-in-part of application No. 11/336,711, filed on Jan. 20, 2006, now Pat. No. 7,201,620.

(30) Foreign Application Priority Data

Jan. 20, 2005 (JP) ..... 2005-012847

(51) Int. Cl.
*B63H 21/22* (2006.01)

(52) U.S. Cl. ..... 440/1; 440/2

(58) Field of Classification Search ..... 440/1, 440/2

See application file for complete search history.

(56) References Cited

U.S. PATENT DOCUMENTS 3,183,879 A 5/1965 Heidner
4,423,630 A 1/1984 Morrison
4,445,473 A 5/1984 Matsumoto
4,492,195 A 1/1985 Takahashi et al.

(Continued)

FOREIGN PATENT DOCUMENTS

CA 2271332 2/2000

(Continued)

OTHER PUBLICATIONS

Advertisement for trim adjuster for Sea-Doo watercraft-Personal Watercraft Illustrated, Aug. 1998.

(Continued)

*Primary Examiner*—Stephen Avila
(74) *Attorney, Agent, or Firm*—Knobbe, Martens, Olson & Bear, LLP

(57) ABSTRACT

An operation control system for a planing boat can include a mode selection module configured to allow a driver to select a driving mode of either one of a normal operation mode, in which the boat cruises at a speed in response to the displacement of an acceleration controller, and a speed-fixing mode, in which the boat cruises at a fixed speed at a level when a speed-fixing controller is operated. The system can also include a planing condition determination module configured to determine whether a hull is at the stage of planing, in which the mode selection module is configured to prohibit the driving mode from switching to the speed-fixing mode if the planing condition determination module determines that the hull is not at the stage of planning. The mode selection module can also be configured to permit the driving mode to switch to the speed-fixing mode if the planing condition determination module determines that the hull is at the stage of planing. The system can also include an aural reporting device configured to emit aural reports depending on the inputs issued by the operator.

18 Claims, 11 Drawing Sheets

U.S. PATENT DOCUMENTS 4,556,005 A 12/1985 Jackson
4,767,363 A 8/1988 Uchida et al.
4,949,662 A 8/1990 Kobayashi
4,961,396 A 10/1990 Sasagawa
4,971,584 A 11/1990 Inoue et al.
4,972,792 A 11/1990 Yokoyama et al.
4,989,533 A 2/1991 Horuichi
5,094,182 A 3/1992 Simner
5,113,777 A 5/1992 Kobayashi
5,118,315 A 6/1992 Funami et al.
5,144,300 A 9/1992 Kanno
5,167,546 A 12/1992 Whipple
5,167,547 A 12/1992 Kobayashi et al.
5,169,348 A 12/1992 Ogiwara et al.
5,184,589 A 2/1993 Nonaka
5,199,261 A 4/1993 Baker
5,203,727 A 4/1993 Fukui
5,244,425 A 9/1993 Tasaki et al.
5,350,325 A 9/1994 Nanami
5,352,138 A 10/1994 Kanno
5,366,394 A 11/1994 Kanno
5,367,970 A 11/1994 Beauchamp et al.
5,408,948 A 4/1995 Arii et al.
5,429,533 A 7/1995 Kobayashi et al.
5,474,007 A 12/1995 Kobayashi
5,520,133 A 5/1996 Wiegert
5,538,449 A 7/1996 Richard
5,591,057 A 1/1997 Dai et al.
5,603,644 A 2/1997 Kobayashi et al.
5,665,025 A 9/1997 Katoh
5,687,694 A 11/1997 Kanno
5,697,317 A 12/1997 Pereira
5,707,264 A 1/1998 Kobayashi et al.
5,713,297 A 2/1998 Tani et al.
5,805,054 A * 9/1998 Baxter ..... 340/426.11
5,826,557 A 10/1998 Motoyama et al.
5,839,700 A 11/1998 Nedderman, Jr.
5,904,604 A 5/1999 Suzuki et al.
5,908,006 A 6/1999 Ibata
5,941,188 A 8/1999 Takashima
5,988,091 A 11/1999 Willis
6,032,605 A 3/2000 Takashima
6,032,653 A 3/2000 Anamoto
6,038,995 A 3/2000 Karafiath et al.
6,062,154 A 5/2000 Ito
6,086,437 A 7/2000 Murray
6,102,755 A 8/2000 Hoshiba
6,116,971 A * 9/2000 Morikami ..... 440/2
6,135,095 A 10/2000 Motose et al.
6,138,601 A 10/2000 Anderson et al.
6,148,777 A 11/2000 Motose et al.
6,159,059 A 12/2000 Bernier et al.
6,168,485 B1 1/2001 Hall et al.
6,171,159 B1 1/2001 Shen et al.
6,174,210 B1 1/2001 Spade et al.
6,178,907 B1 1/2001 Shirah et al.
6,202,584 B1 3/2001 Madachi et al.
6,213,044 B1 4/2001 Rodgers et al.
6,216,624 B1 4/2001 Page
6,227,919 B1 5/2001 Blanchard
6,244,914 B1 6/2001 Freitag et al.
6,273,771 B1 8/2001 Buckley et al.
6,305,307 B1 10/2001 Yokoya
6,314,900 B1 11/2001 Samuelsen
6,332,816 B1 12/2001 Tsuchiya et al.
6,336,833 B1 1/2002 Rheault et al.
6,336,834 B1 1/2002 Nedderman, Jr. et al.
6,386,930 B2 5/2002 Moffet
6,390,862 B1 5/2002 Eichinger
6,405,669 B2 6/2002 Rheault et al.
6,415,729 B1 7/2002 Nedderman, Jr. et al.
6,428,371 B1 8/2002 Michel et al.
6,428,372 B1 8/2002 Belt
6,443,785 B1 9/2002 Swartz et al.
6,478,638 B2 11/2002 Matsuda et al.
6,508,680 B2 1/2003 Kanno
6,511,354 B1 1/2003 Gonring et al.
6,523,489 B2 2/2003 Simzrd et al.
6,530,812 B2 3/2003 Koyano et al.
6,551,152 B2 4/2003 Matsuda et al.
6,565,397 B2 5/2003 Nagafusa
6,568,968 B2 5/2003 Matsuda et al.
6,668,796 B2 12/2003 Umemoto et al.
6,695,657 B2 2/2004 Hattori
6,701,897 B2 3/2004 Chatfield
6,709,302 B2 3/2004 Yanagihara
6,709,303 B2 3/2004 Umemoto et al.
6,722,302 B2 4/2004 Matsuda et al.
6,722,932 B2 4/2004 Yanagihara
6,732,707 B2 5/2004 Kidokoro et al.
6,733,350 B2 5/2004 Iida et al.
6,776,676 B2 8/2004 Tanaka et al.
6,783,408 B2 8/2004 Uraki et al.
6,805,094 B2 10/2004 Hashimoto et al.
6,827,031 B2 12/2004 Aoyama
6,855,014 B2 2/2005 Kinoshita et al.
6,863,580 B2 3/2005 Okuyama
6,884,128 B2 4/2005 Okuyama et al.
6,886,529 B2 5/2005 Suzuki et al.
6,990,953 B2 1/2006 Nakahara et al.
6,997,763 B2 2/2006 Kaji
7,037,147 B2 5/2006 Kinoshita et al.
7,089,910 B2 8/2006 Kanno et al.
7,118,431 B2 10/2006 Mizuno et al.
7,160,158 B2 1/2007 Kinoshita
7,166,003 B2 1/2007 Motose
7,168,995 B2 1/2007 Masui et al.
7,201,620 B2 4/2007 Kinoshita et al.
7,207,856 B2 4/2007 Ishida et al.
7,337,739 B2 3/2008 Kaneko et al.
2003/0089166 A1 5/2003 Mizuno et al.
2004/0065300 A1 * 4/2004 Watabe et al. ..... 123/396
2004/0147179 A1 7/2004 Mizuno et al.
2005/0118895 A1 * 6/2005 Kanno et al. ..... 440/2
2005/0263132 A1 12/2005 Yanagihara
2005/0273224 A1 12/2005 Ito et al.
2005/0287886 A1 12/2005 Ito et al.
2006/0004502 A1 1/2006 Kaneko et al.
2006/0160437 A1 7/2006 Kinoshita et al.
2007/0021015 A1 1/2007 Kinoshita et al.

FOREIGN PATENT DOCUMENTS

JP 06-137248 5/1994
JP 7-40476 9/1995
JP 2001-152895 6/2001
JP 2001-329881 11/2001
JP 2002-180861 6/2002
JP 2004-092640 3/2004
JP 2004-137920 5/2004
WO WO 00/40462 7/2000

OTHER PUBLICATIONS

Advertisement for trim adjuster-Jet Sports, Aug. 1997.
Advertisement for Fit and Trim and Fit and Trim II—Jet Sports. Aug. 1996.

* cited by examiner

| Events | Exemplary Aural Reports | Other Indicators |
|---|---|---|
| The normal operation mode → The speed-fixing mode | *100* 0.05 sec x 3 (*e.g. S11-2*) 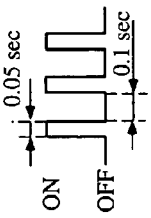  | *102* Speed display on the display means blinks on and off at the set speed. (*e.g. S12*)   |
| (Under the speed-fixing mode) Operating the speed fine adjustment means for acceleration or deceleration | *104* 0.1 sec x 1 (*e.g. S19, S23*) 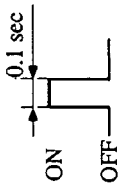  | *106* Speed display on the display means blinks on and off at the adjusted speed. 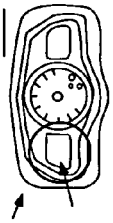  |
| The speed-fixing mode → The normal operation mode | *108* 0.1 sec x 2 (*e.g. S24-1*) 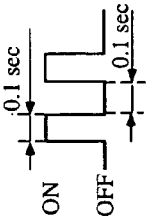  | *110* Blinking speed display is canceled. (*e.g. S24-2*) |
| Maintenance Required (e.g. low fuel, oil, etc.) | 0.5 sec (continual) 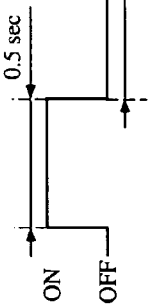  | *112* |

*Figure 8A*

OPERATION CONTROL SYSTEM FOR PLANING BOAT

PRIORITY INFORMATION

The present application is a continuation-in-part of U.S. patent application Ser. No. 11/336,711 filed Jan. 20, 2006 now U.S. Pat. No. 7,201,620, which is based on and claims priority under 35 U.S.C. § 119(a-d) to Japanese Patent Application No. 2005-012847, filed on Jan. 20, 2005 the entire contents of both of which is expressly incorporated by reference herein.

BACKGROUND OF THE INVENTIONS

1. Field of the Inventions

These inventions relate to a planning-type watercraft, and more particularly to improvements in operation control systems for such watercraft.

2. Description of the Related Art

When driving a watercraft into or out of a marina, operators must drive at speeds lower than about five miles per hour. These areas are all often referred to as "No Wake Zones." Operating a boat at such a low speed can be tiresome.

For example, watercraft that include throttle levers that are biased toward a closed position, such as those used on personal watercraft and some jet boats, require the operators to hold the throttle lever with their fingers or foot in a position so as to hold the throttle lever at a precise location so that the watercraft will move only at a slow speed. Thus, more recently, some small watercraft have been provided with cruise control systems that facilitate smooth acceleration for cruising in a speed-limited area as well as for longer cruising uses.

For example, Japanese Patent Document JP-A-2002-180861 discloses a cruise control system for a planning-type watercraft in which, with a throttle valve opened to a driver-determined position, the driver can turn-on a cruise control operation switch to control the degree of throttle opening such that the then current engine speed is maintained.

SUMMARY OF THE INVENTIONS

An aspect of at least one of the embodiments disclosed herein includes the realization that when using a cruise control system such as that described in JP-A-2002-180861, the watercraft can change cruising speed significantly even if the engine speed is maintained at a constant speed. This is due to the differences in hydrodynamic drag on the hull when the watercraft is in a displacement mode compared to when the watercraft is in a planning mode. For example, if an engine speed is held constant, and the watercraft transitions from a displacement mode (in which the drag on the hull is higher) to a planning mode (in which the drag on the hull is lower), the watercraft accelerates and begins to cruise at a higher watercraft speed, even if the speed of the engine is held constant.

As shown in FIGS. 9(*a*) and 9(*b*), users can accelerate planning-type boats under the maximum engine speed by abruptly increasing the throttle opening from an idle throttle opening to a fill throttle opening. This, however, results in a delay in increasing the cruising speed relative to the almost immediate increase in engine speed to the maximum engine speed.

Thus, with a conventional cruise control system, when the driver turns-on the cruise control operation switch during displacement more operation (before planning), the engine speed is fixed at the then current speed. Under certain situations, the boat starts planing under this fixed engine speed. This results in the cruising speed of the watercraft being higher than the speed of the watercraft when the cruise control was actuated. Drivers can find this acceleration unacceptable.

Thus, in accordance with an embodiment, an operation control system for a planning-type boat can be provided. The control system can include mode selection means for selecting a driving mode, the driving mode comprising at least one of a normal operation mode, in which the boat cruises at a speed in response to the displacement of an acceleration controller, and a speed-fixing mode in which the boat cruises at a fixed speed determined when a speed-fixing controller is operated. The system can further comprise planing condition determination means for determining whether a hull of the planning-type boat is at a stage of planing. The mode selection means can prohibit the driving mode from switching to the speed-fixing mode if the planing condition determination means determines that the hull is not at the stage of planing. The mode selection means can also permit the driving mode to switch to the speed-fixing mode if the planing condition determination means determines that the hull is at the stage of planing.

In accordance with another embodiment, an operation control system for a planning-type boat can be provided. The boat can include a hull, an engine supported by the hull, an acceleration input device configured to be operable by a driver of the boat. A mode selection module can be configured to allow a driver of the boat to select a driving mode, the driving mode comprising at least one of a normal operation mode, in which the boat cruises at a speed in response to the displacement of the acceleration input device, and a speed-fixing mode in which the boat cruises at a fixed speed determined when a speed-fixing controller is operated. The system can further comprise a planing condition determination module configured to determine whether the hull is at a stage of planing. The mode selection module can also be configured to prohibit the driving mode from switching to the speed-fixing mode if the planing condition determination module determines that the hull is not at the stage of planing, and configured to permit switching of the driving mode to the speed-fixing mode if the planing condition determination module determines that the hull is at the stage of planing.

Another aspect of at least one of the embodiments disclosed herein includes the realization that when a user attempts to adjust a setting of the watercraft while the watercraft is at planing speed, it is helpful if the watercraft can emit an aural report that is perceptible by the operator when the operator attempts to adjust those settings. For example, but without limitation, when the operator of a watercraft is attempting to adjust a setting related to the speed fixing mode described above, it is helpful to the operator if the watercraft emits a sound, tone, buzzer or other audiable report, to let the operator know that the watercraft has received the setting adjustment request from the operator. In some embodiments, a watercraft can have buttons disposed in the operator's area of the watercraft. When the operator wishes to request a setting adjustment, such as the target speed set for the speed fixing mode, the watercraft can emit a buzzer sound each time the operator depresses the button. As such, the operator is immediately advised that the watercraft has received the request to change the speed setting and the operator does not need to further attempt to confirm that the speed setting has been changed.

Thus, in accordance with an embodiment, an operation control system for a planning-type boat can comprise mode selection means for selecting a driving mode, the driving mode comprising at least one of a normal operation mode, in which the boat cruises at a speed in response to the displacement of an acceleration controller, and a speed-fixing mode in which the boat cruises at a fixed speed determined when a speed-fixing controller is operated. The system can further comprise an aural reporting device configured to issue a first aural report when an operator inputs a command into the mode selection means.

In accordance with another embodiment, an operation control system for a planing-type boat comprising a hull and an engine supported by the hull, the operation control system can comprise an acceleration input device configured to be operable by a driver of the boat, a mode selection module configured to allow a driver of the boat to select a driving mode. The driving mode can comprise at least one of a normal operation mode, in which the boat cruises at a speed in response to the displacement of the acceleration input device, and a speed-fixing mode in which the boat cruises at a fixed speed determined when a speed-fixing controller is operated. The system can further comprise an aural reporting device configured to emit a first aural report when an input is issued to the mode selection module.

In accordance with yet another embodiment, . . .

BRIEF DESCRIPTION OF THE DRAWINGS

The abovementioned and other features of the inventions disclosed herein are described below with reference to the drawings of the preferred embodiments. The illustrated embodiments are intended to illustrate, but not to limit the inventions. The drawings contain the following figures:

FIG. 8A is a table including exemplary aural and other indicators that can be used in combination with the control operation programs illustrated in FIGS. 5-8.

DETAILED DESCRIPTION OF THE PREFERRED EMBODIMENT

Figure 1:
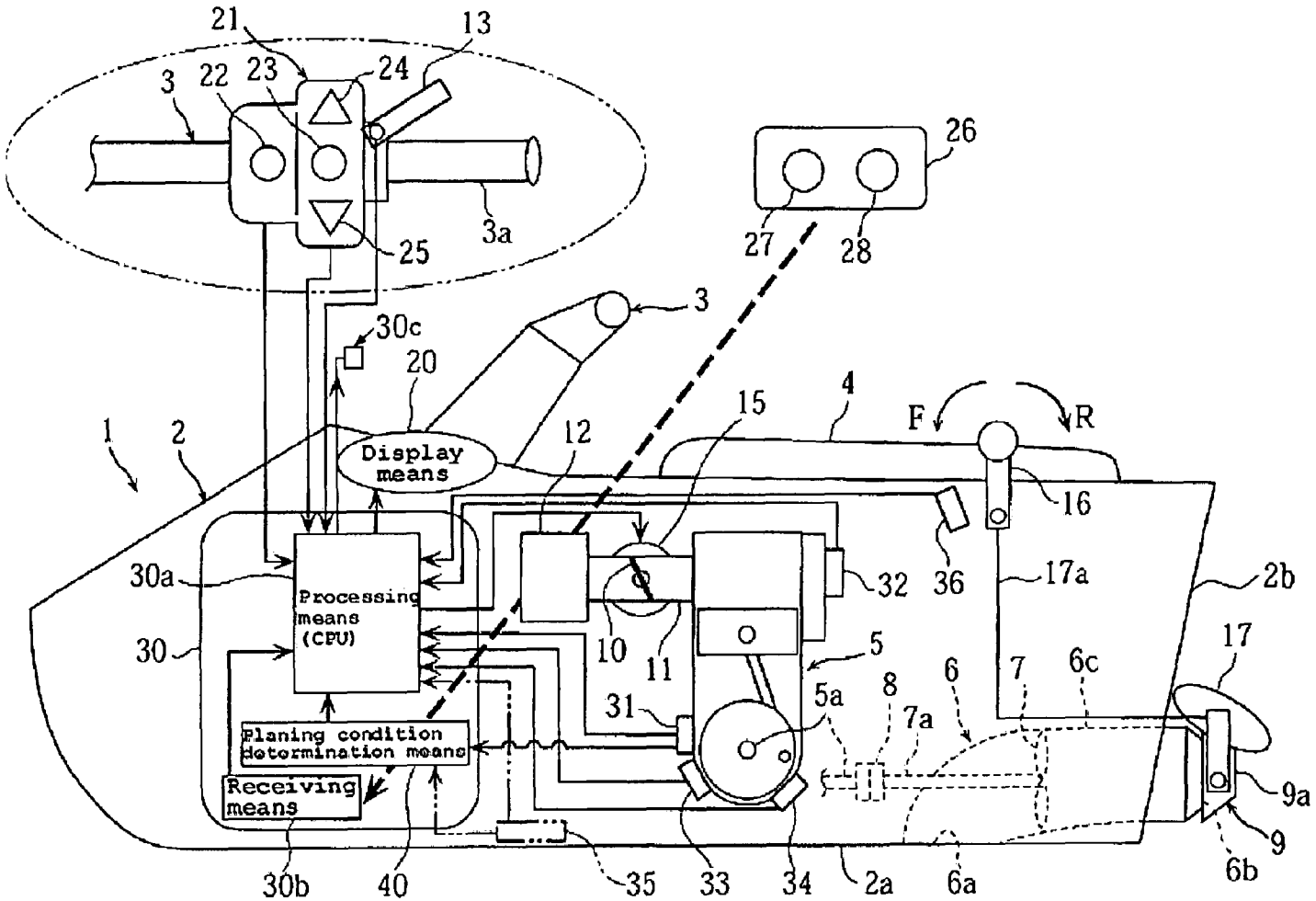
FIG. 1 is a schematic diagram of a planning-type boat having an operation control system according to an embodiment.

The planing boat 1 can include a box-shaped, generally watertight hull 2, a steering handlebar 3 located at the forward upper surface of the hull, a straddle type seat 4 located at the rearward upper surface of the hull, an engine 5 and a propulsion unit 6 both accommodated in the hull 2. However, other configurations can also be used. The operation control system and methods described herein are disclosed in the context of a personal watercraft because they have particular utility in this context. However, the operation control system and methods described herein can also be used in other vehicles, including small jet boats, as well as other watercraft and land vehicles.

The propulsion unit 6 can include an inlet port 6*a* having an opening at a bottom 2*a* of the hull 2, an outlet port 6*b* having an opening at a stern 2*b*, and a propulsion passage 6*c*. The inlet and outlet ports can communicate through the propulsion passage.

An impeller 7 can be disposed within the propulsion passage 6*c*. An impeller shaft 7*a* of the impeller 7 can be coupled to a crankshaft 5*a* of the engine 5 through a coupling 8. The impeller shaft 7 can be comprised of one or plurality of shafts connected together. The engine 5 can thus drive the impeller 7 so as to rotate. This pressurizes the water drawn from the inlet port 6*a* and emits a jet of the pressurized water rearward from the outlet port 6*b*, thereby producing thrust.

To the outlet port 6*b*, a jet nozzle 9 can be connected for swinging movement to the left or right. The handlebar 3 can be connected to the jet nozzle 9 with any known connection device. Thus, steering the steering handlebar 3 to the left or right allows the jet nozzle 9 to swing left or right, thereby turning the hull 2 left or right.

The engine 5 can be mounted with its crankshaft 5*a* oriented in the front-to-rear direction of the hull, however, other configurations or orientations can also be used.

A throttle body 11 incorporating a throttle valve 10 can be connected to the engine 5. A silencer 12 can be connected to the upstream end of the throttle body 11.

An acceleration lever (controller) 13 can be disposed at a grip portion 3*a* of the steering handlebar 3 and can be operated, by a driver of the planing-type boat, to open/close the throttle valve 10. An actuator 15 can be connected to the throttle valve 10 to open/close the throttle valve 10. A control unit 30, described in greater detail below, drives and controls the actuator 15.

A forward/reverse drive shift lever 16 (which can function as a forward/reverse drive shifting means) can be disposed in the vicinity of the seat provided on the hull 2. The forward/reverse drive shift lever 16 can be linked to a reverse bucket 17 disposed on the jet nozzle 9 via an operation cable 17*a*.

When the forward/reverse drive shift lever 16 is rotated to a forward-drive position F, the reverse bucket 17 can be moved to allow a jet port 9*a* of the jet nozzle 9 to be opened. Water jet can be directed rearward so that the hull 2 moves forwardly. When the forward/reverse drive shift lever 16 is rotated to a reverse-drive position R, the reverse bucket 17 can be positioned to the rear of the jet port 9*a*. Water jet flow hits the reverse bucket 17 and is thus redirected toward the front of the hull 2, thereby moving the hull 2 in a reverse direction.

The steering handlebar 3 on the hull 2 can be provided with an operation box 21. In front of the steering handlebar 3, a display device 20 can also be provided. Reference numeral 26 denotes a remote control switch. The remote control switch 26 may be disposed on the hull.

The display device 20 can include a speedometer, a fuel gauge, and various display lamps (not shown). However, other gauges and displays can also be used. When any one of a low-speed setting mode, a speed-limiting mode and a speed-fixing mode is selected with, for example, the operation box 21, the display device lights a display lamp that responds to the selected mode.

Figure 1A:
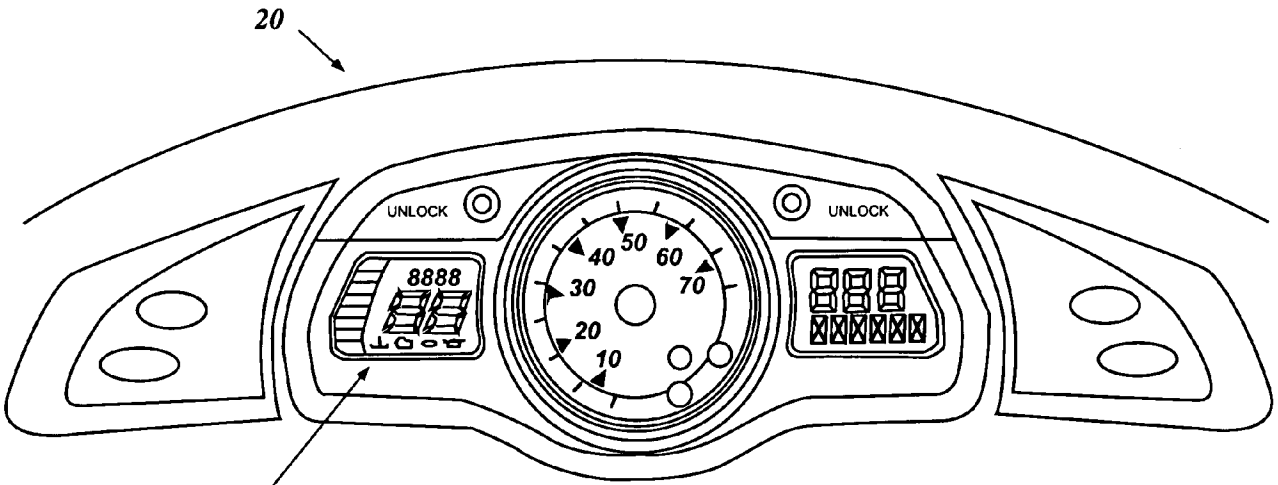
FIG. 1A is a rear elevational view of a display device that can be used with the planing type boat of FIG. 1.
Figure 1B:
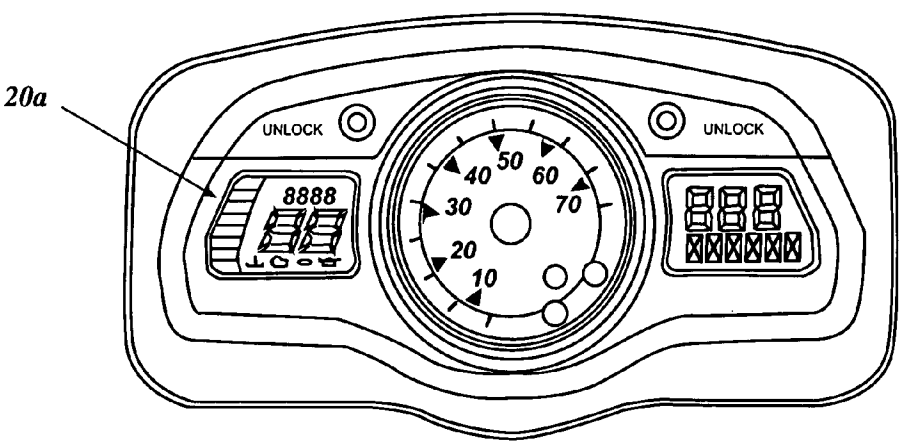
FIG. 1B is a schematic diagram of the display device illustrated in FIG. 1A.
Figure 2:
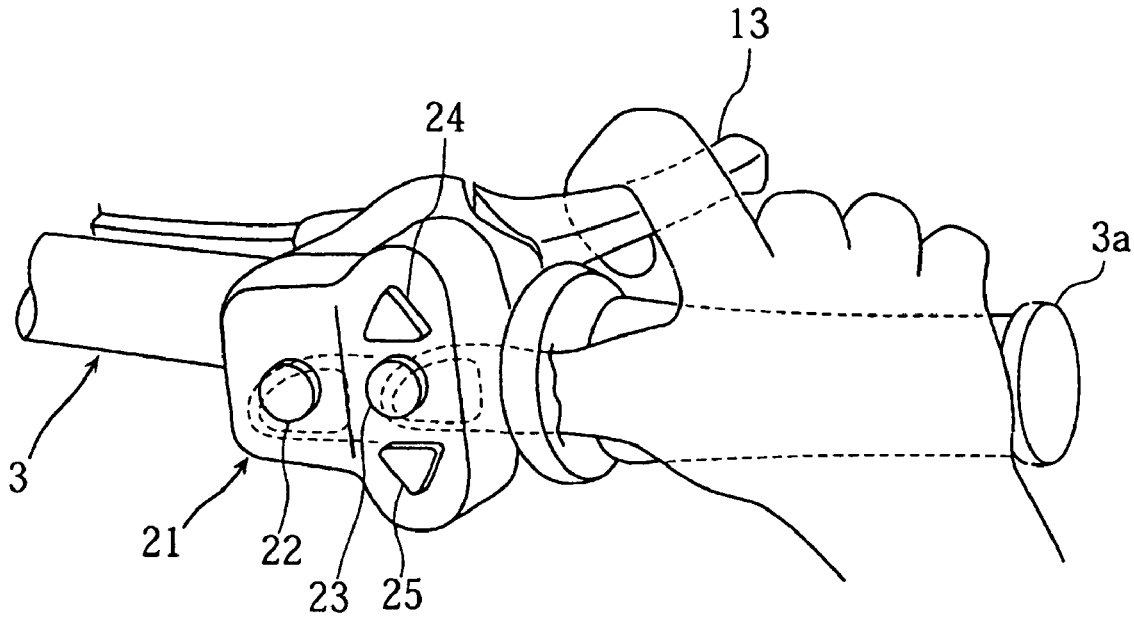
FIG. 2 is an enlarged perspective view of a portion of a steering handlebar of the planning-type boat.

With reference to FIGS. 1A and 1B, which illustrate exemplary but non-limiting embodiments of the display device 20, the display device 20 can include a speedometer device 20*a* that is configured to display at least a current speed of the watercraft 1. The speed displayed by the speedometer 20*a* can be a speed detected directly by a watercraft speed sensor (not shown), such as, for example, but without limitation, a pitot tube water speed sensor, a paddle wheel-type sensor, or any other sensor. Optionally, the speed displayed by the speedometer 20*a* can be a speed calculated based on the speed of the engine, described in greater detail below in paragraphs.

As illustrated in FIGS. 1A and 1B, the speedometer 20*a* can be a general purpose display device having a plurality of logos or images corresponding to different functions and/or sensors, as well as a generic numerical read-out constructed of an LCD panel and/or other devices, although other configurations can also be used. In the illustrated embodiment, the speedometer 20*a* is formed with a 3-digit LCD display configured to display any number from zero to 199. However, other configurations can also be used.

The speedometer 20*a* can be configured to visually display the mode under which the watercraft 1 is operating, for example, but without limitation, the low speed setting mode, the speed limiting mode, and the speed fixing mode. However, the speedometer 20*a* can also be configured to display the operation of other modes as well.

In some embodiments, the speedometer 20*a* can be configured to display three different logos corresponding to each one of the low speed setting mode, speed limiting mode, and the speed fixing mode. Alternatively, the speedometer 20*a* can include a portion that simply blinks a number of times based on which of the above-identified modes are active. However, other configurations can also be used.

Further, the 3-digit area of the speedometer 20*a* can be configured to normally indicate the present speed of the watercraft 1. Optionally, the 3-digit portion of the speedometer 20*a* can be configured to display the target speed set by the operator for any of the above-identified modes, including the speed fixing mode. For example, when an operator of the watercraft changes a target speed of the speed fixing mode, the 3-digit portion of the speedometer 20*a* can temporarily flash the new target speed setting, then return to displaying the current watercraft speed. Such modes of operation are described in greater detail below with reference to FIG. 8A.

The operation box 21 can be located inner side of the grip portion 3*a* of the steering handlebar 3 in the vehicle width direction. The operation box 21 can be provided with a low-speed setting switch 22, a speed-fixing switch 23, and acceleration/deceleration fine adjustment switches 24, 25. All the switches 22 to 25 can be disposed in an area where the driver's thumb can reach for operating these switches while the driver grabs the grip portion 3*a*. However, other configurations and arrangements can also be used. The remote control switch 26 can be provided with a speed-limiting switch 27 and a speed-limiting cancellation switch 28.

The planing boat 1 can have a control unit 30 for controlling all operations of the boat 1 including the engine. The control unit 30 can be configured to receive input values detected by various sensors including an engine speed sensor 31, a throttle opening sensor (not shown), an engine coolant temperature sensor 32, a lubricant temperature sensor 33, a lubricant pressure sensor 34, a cruising speed sensor 35 and a forward/reverse drive shift position sensor 36. However, other sensors can also be used.

Figure 4:
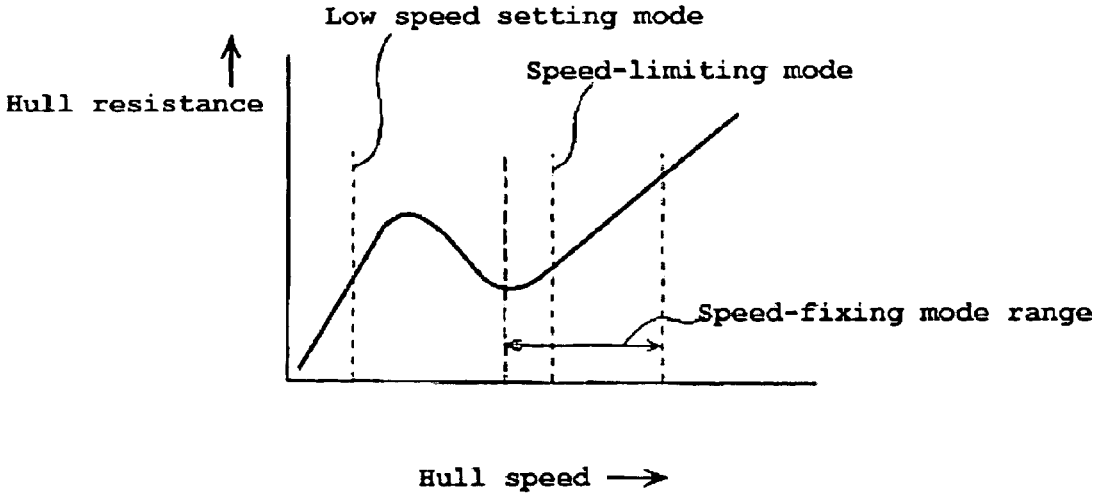
FIG. 4 is an exemplary but non-limiting characteristic map, showing operation ranges of the planning-type boat in various modes.

The control unit 30 can include processing means (CPU) 30*a* for driving and controlling the actuator 15 and the like. The processing means 30*a* can be configured to receive operation signals input from the low-speed setting switch 22, the speed-fixing switch 23, and the acceleration/deceleration fine adjustment switches 24, 25, and/or other switches or input devices. The processing means 30*a* can also be configured to receive operation signals input from the speed-limiting switch 27 and the speed-limiting cancellation switch 28 through receiving means 30*b*, and/or other switches or input devices. The control unit 30 can be configured to select among the cruising modes based on the operation signals from the switches (See FIG. 4).

For example, while in the normal operation mode, in which the boat 1 cruises at a speed in response to the displacement of the acceleration lever 13 by the driver, the low-speed setting switch 22 can be kept pressed by the driver, for example, for a certain time period. Then, the control unit 30 can change the mode to the low-speed setting mode and control the throttle opening to achieve a predetermined low boat speed (e.g. 8 km/h). The low-speed setting mode can be applicable to cruising in a limited or reduced speed area, such as shallow water, boat mooring sites, no wake zones, or other areas.

When the normal operation mode is selected, the speed-limiting switch 27 can also be depressed for a certain time period. Then, the control unit 30 can change the operation mode of the engine to the speed-limiting mode and control the throttle opening such that the engine speed does not exceed a predetermined value. The control unit 30 can be configured not to change the mode to the speed-fixing mode if the speed-limiting mode has already been selected. The speed-limiting mode can be applicable to cruising in a speed limited area or long-time or longer-distance touring.

When the normal operation mode is selected, the speed-fixing switch 23 can be depressed for a certain time period. Then, the control unit 30 can change the driving mode to the speed-fixing mode, which can be the automatic cruising mode, and can control the throttle opening to fix the cruising speed of the boat 1 at the then current boat speed when the speed-fixing switch is pressed. The speed-fixing mode can be applicable to cruising at driver's desirable speed from low to high speed range, or at a speed which improves fuel efficiency.

Optionally, the watercraft 1 can also include an aural signaling device 30*c*. The aural signaling device 30*c* can be in the form of any device configured to emit a sound that can be perceived by the operator of the watercraft 1. Such an aural reporting device 30*c* can be in the form of a buzzer, a speaker, or any other type of tone or sound generation device.

Advantageously, the aural reporting device 30*c* can be configured to operate under at least one mode in which it can emit at least one sound that is perceptible by an operator of the watercraft 1 when the watercraft 1 is operating at a planing speed. This provides further advantages because some of the operations disclosed herein regarding the aural reporting device 30*c* are performed while the watercraft 1 is at planing speed.

When a watercraft such as the watercraft 1 is operating at planing speed, there can be a significantly greater amount of noise generated from the watercraft 1 than when the watercraft 1 is operating at lower speeds, in a "displacement" mode. For example, at planing speed, often times the outlet of an exhaust system of such watercraft rises above the water line, thereby generating a louder exhaust sound from the watercraft 1. Additionally, wind impacting the operator's head during forward movement can create a rumbling noise which can make it more difficult to hear quiet sounds. Thus, the aural reporting device 30*c* should be configured to produce a sound loud enough to be heard by an operator of the watercraft 1 while the watercraft 1 is at a planing speed.

Optionally, the aural reporting device 30*c* can have at least a plurality of volume settings. For example, the control unit 30 can be configured to operate the aural reporting device 30*c* at a first lower volume when the watercraft 1 is at idle or operating at speeds below a planing speed, and to operate the aural reporting device 30*c* at a second higher volume setting, having a volume sufficient to be heard by an operator of the watercraft 1 when the watercraft 1 is at planing speed. However, other arrangements and configurations can also be used.

The control unit 30 can include a planing condition determination means 40 for determining whether or not the hull 2 is at the stage of planing. If the planing condition determination means 40 determines that the hull is at the stage of planing, the control unit permits the driving mode to switch to the speed-fixing mode. If the planing condition determination means 40 determines that the hull is not at the stage of planing, the control unit prohibits the driving mode from switching to the speed-fixing mode. The planing condition determination means 40 can be configured to determine whether or not the hull 2 is in a planing or displacement mode using any of a variety of calculations, including, but without limitation, an average based on a detected speed of the engine.

For example, if a moving average is calculated based on a detected engine speed is kept lower than a preset value for a predetermined time period, the boat can be determined not to be in a planning mode. If the moving average is maintained higher than the preset value for the predetermined time period, the boat can be determined to be at or in a planning mode.

The aforementioned moving average can refer to an engine speed obtained based on a simple moving average, weighted moving average and/or smoothed exponential moving average. For example, the moving average Ne calculated based on the simple moving average can be expressed as follows:

$$Ne=(N_1+N_2+N_3+N_4)/4$$

where $N_1$, $N_2$, $N_3$, $N_4$ are engine speeds sampled at certain intervals by the engine speed sensor 31.

The moving average Ne calculated based on the weighted moving average can be expressed as follows:

$$Ne=(N_1\times K_1+N_2\times K_2+N_3\times K_3+N_4\times K_4)/(K_1+K_2+K_3+K_4)$$

wherein Kn is a sampling weighted coefficient and Kn>Kn−1>1. The moving average $Ne_t$ at time t calculated based on the smoothed exponential moving average can be expressed as follows:

$$Ne_t=Ne_{t-1}+(N_t-Ne_{t-1})\times K$$

wherein K is resistance coefficient of the boat.

Figure 3:
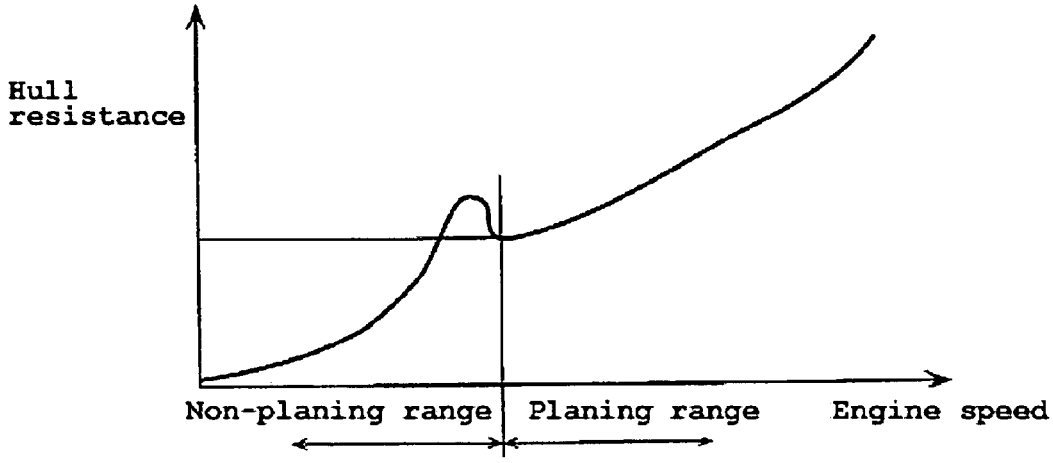
FIG. 3 is an exemplary but non-limiting characteristic map, showing a relationship between hull resistance of the planning-type boat and engine speed.

FIG. 3 shows an exemplary but non-limiting relationship between engine speed and hull resistance, and particularly shows a sharp increase in hull resistance just prior to the border between non-planning and planing ranges. As the engine speed, and then the cruising speed, increase from the idling level and approximate to a level of the border, the hull weighted center moves to the rear of the hull. This causes a sharp increase in hull resistance as shown in the FIG. 3. When the engine speed further increases to a certain speed, referred to herein as the "hump speed", the hull weighted center moves toward the front of the hull 2, and the hull 2 also rises somewhat relative to the waterline of the hull 2 so that the hull 2 resistance decreases. A range of speeds over the hump can be called the planing range.

Figure 5:
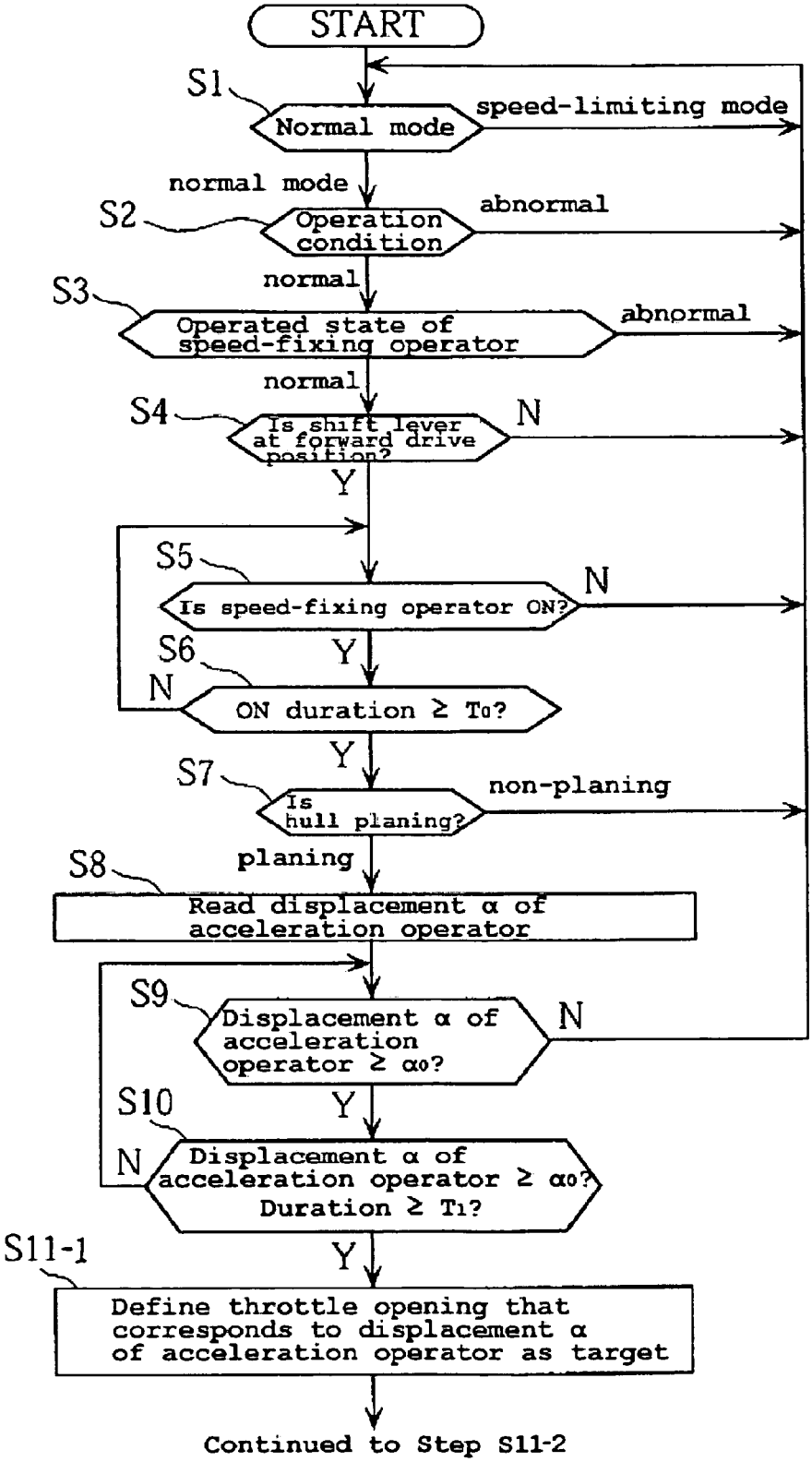
FIG. 5 is a flowchart of a control operation that can be used with the operation control system of FIG. 1.

A control operation that can be used with the control unit 30 is described in detail with reference to the flowcharts in FIGS. 5 and 6.

When a main switch is turned ON to start the engine 5, a determination can be made whether or not the normal operation mode has been selected. If it is determined that the normal operation mode has been selected, another determination can be made whether or not the engine operates and each sensor functions normally. Then, a further determination can be made whether or not the speed-fixing switch 23 is operated normally (steps S1 to S3). These determinations can be made in any known manner, for example, through known diagnostic routines for verifying the proper operation of sensors and/or other engine functions.

If all are determined to be under normal conditions in the steps S2 and S3, another determination can be made whether or not the forward/reverse drive shift lever 16 is at the forward drive position (step S4). If the forward/reverse drive shift lever 16 is determined to be at the forward drive position F, a further determination can be made whether or not the speed-fixing switch 23 has been turned ON (step S5).

If the speed-limiting mode has been selected in the step S1, or the engine fails to operate normally or the switch fails to be operated normally in the steps S2 and S3, or the forward/reverse drive shift lever is at the reverse drive position in the step S4, the process flow goes back to the step S1 to repeat the process.

The engine 5 can be determined not to operate normally, for example, if at least one of the lubricant temperature, coolant temperature and lubricant pressure exceeds its preset value.

The speed-fixing switch 23 can be determined not to be operated normally if a voltage of a lead wire for connecting the speed-fixing switch 23 to the control unit 30 does not fall within a normal value range. In addition, if the voltage value, obtained when the speed-fixing switch 23 is operated, can be kept normal for a predetermined time period or longer, the operated state of the switch can be determined to be abnormal because of a possibility that the speed-fixing switch 23 could be forcibly stuck in the ON position due to dust.

If the speed-fixing switch 23 is turned ON in the step S5, the duration that the switch can be kept ON is measured. If the duration is equal to or longer than a preset time $T_0$, a determination can be made whether or not the hull is at the stage of planing (steps S6 and S7). If the duration that the switch is kept ON is shorter than $T_0$ in the step S6, the process flow goes back to the step S5.

If the hull is determined to be at the stage of planing in the step S7, a current displacement $\alpha$ of the acceleration lever 13 can be read (step S8). If the current displacement $\alpha$ is equal to a preset value $\alpha_0$ or greater, the duration that the displacement $\alpha$ is maintained is measured. If the duration is equal to $T_1$ or longer (steps S9 and S10), a throttle opening that corresponds to the displacement $\alpha$ is defined as a target while the display lamp lights to indicate that the speed-fixing mode can be selected (steps S11-1 and S12 (FIG. 6)). The opening/closing degree of the throttle valve 10 can be controlled through the actuator 15 such that the throttle opening reaches and is maintained at the target.

Figure 6:
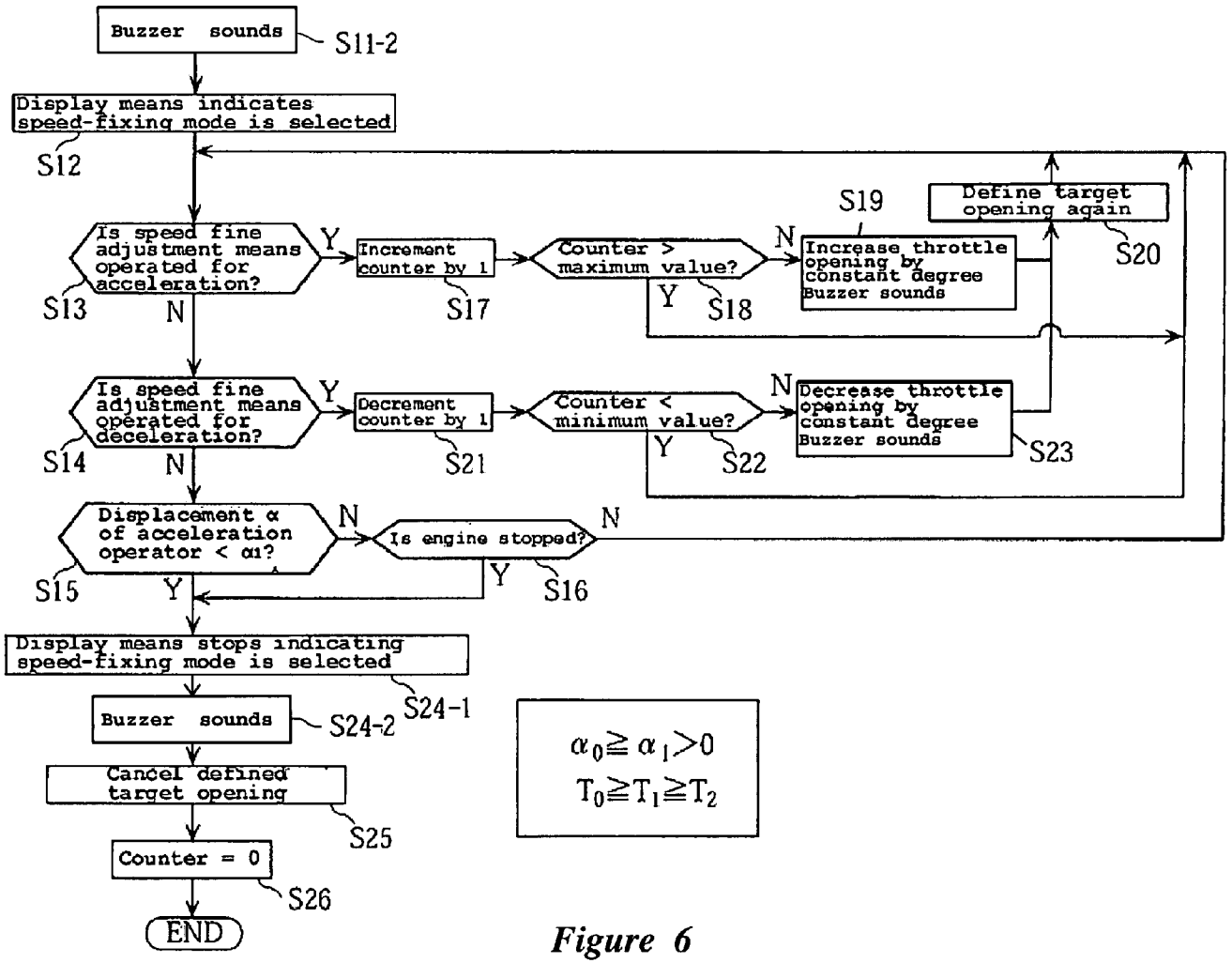
FIG. 6 is a flowchart of a control operation that can be used with the operation control system of FIG. 1.

Advantageously, with reference to FIG. 6, the aural reporting device 30*c* can be activated to issue a report that is perceptible by an operator of the watercraft 1 when the speed fixing mode is selected. Thus, for example, as shown in FIG. 6, the control operation can include step S11-2 in which the aural reporting device 30*c* is activated to issue a report that is perceptible, or in other words, audiable, to an operator of the watercraft 1. In some embodiments, the report issued from the aural reporting device 30*c* is a buzzer sound. This buzzer sound can be of any duration or pattern. In some embodiments, the buzzer sound issued at step S11-2 is different from other tones or buzzer sounds issued by the aural reporting device 30*c*. Examples of different buzzer sounds are described below with reference to FIG. 8A.

With continued reference to FIG. 6, while the boat cruises in this speed-fixing mode, if fine adjustments for acceleration/deceleration are not implemented, the displacement $\alpha$ of the acceleration lever 13 is equal to or greater than a predetermined value $\alpha_1$, and the engine 5 is not stopped, then the speed-fixing mode can be maintained (steps S13 to S16).

In the step S13, if the acceleration fine adjustment switch 24 is pressed, a counter value can be increased by one. If the counter value does not reach the maximum value, the throttle opening can be increased by a constant degree, which is again defined as the target (steps S17 to S20).

Advantageously, the control operation can include a step for issuing an aural report, for example, but without limitation, from the aural reporting device 30*c* so as to provide the operator with an indication that the throttle opening or the speed in the speed fixing mode has been adjusted upwards by one increment. As noted above, the report issued by the aural reporting device 30*c* can be any type of sound, tone, or buzzer, etc. Further, the sound, tone, or buzzer can be repeated in any pattern or be of a simple single pulse. Further exemplary aural reports are described in greater detail below with reference to FIG. 8A.

Optionally, as illustrated in FIG. 6, the step S19 can include the functions of both increasing the throttle opening by a constant or a predetermined degree and controlling the aural report device 30*c* to issue the aural report described above.

In the step S14, if the deceleration fine adjustment switch 25 is pressed, a counter value can be decreased by one. If the counter value does not reach the minimum value, the throttle opening can be decreased by a constant degree, which is again defined as the target (steps S21 to S23).

Further advantages are achieved where the control operation includes a step for issuing an aural report when the throttle opening is decreased, for example, in step S23. As noted above, this is advantageous because the operator is provided with a tone indicating that the request that the operator has made to decrease the throttle opening has been received. Additionally, as noted above, because the watercraft 1 will be planing when the control operation reaches step S23, it is advantageous if the aural reporting device 30*c* is controlled to issue a aural report, such as, for example, but without limitation, a sound, tone, or buzzer, that is audiable when the watercraft 1 is at a planing speed. Further exemplary sound patterns that can be used in conjunction with the present control operation are described below in greater detail with reference to FIG. 8A.

If the displacement $\alpha$ of the acceleration lever 13 becomes lower than the predetermined value $\alpha_1$, the control unit can be configured to determine that the driver desires to clear the speed-fixing mode. Thus, the lamp that indicates the speed-fixing mode has been selected goes out. The defined target throttle opening becomes invalid while the increasing/decreasing counter value can be reset to zero (steps S24-1 to S26). This allows the speed-fixing mode to automatically switch to the normal operation mode. In the step S16, if the engine is stopped, the speed-fixing mode can be cleared to automatically switch to the normal operation mode.

Advantageously, the control operation can include a step S24-2 during which the aural reporting device 30*c* issues a report perceptible by an operator of the watercraft 1. As noted above, the report issued by the aural reporting device 30*c* can be any type of sound, including tones or buzzers or other sounds. Advantageously, the report issued by the aural reporting device 30*c* during step S24-2 is of sufficient volume to be perceptible by an operator of the watercraft 1 when the watercraft 1 is operating at a planing speed. Exemplary patterns of buzzer tones or sounds that can be used during step S24-2 are described below in greater detail with reference to FIG. 8A.

According to some embodiments, if the speed-fixing switch 23 is kept pressed for a certain time period, a determination can be made whether or not the hull 2 is at the stage of planing. Only if the hull is determined to be at the stage of planing, the control unit permits the driving mode to switch to the speed-fixing mode. This enables driver's desired cruising speed to conform to the actual cruising speed, thereby offering cruising comfort for the driver.

In some embodiments, the hull 2 can be determined not to be at the stage of planing, if the moving average obtained based on the engine speed is kept lower than a preset value for a certain time period. This allows the control unit to make a determination whether the hull 2 is at the stage of planing based on a cruising speed that is about the actual speed, using a simpler and less expensive configuration. Further, this makes the determination more accurate, compared to the determination made by using the engine speed itself as a criterion.

In some embodiments, if the forward/reverse drive shift lever 16 is at the reverse-drive position R, the control unit prohibits the driving mode from switching to the speed-fixing mode. This can help the driver refrain from unnecessary operations. In other words, there can be little need or opportunity to switch to the speed-fixing mode during reverse drive.

In some embodiments, if the boat cruises in the speed-fixing mode and the displacement $\alpha$ of the acceleration lever is equal to or greater than the predetermined value $\alpha_1$, then the speed-fixing mode can be maintained. Thus, the driver can maintain the speed-fixing mode with simple operations while easily recognizing that the boat cruises in the speed-fixing mode.

In some embodiments, if the displacement $\alpha$ of the acceleration lever is lower than the predetermined value $\alpha_1$, the speed-fixing mode can be cleared to automatically switch to the normal operation mode. This can be achieved by simple operations.

In some embodiments, if the engine fails to operate normally or each sensor fails to function normally, the control unit 30 can be configured to prohibit the driving mode from switching to the speed-fixing mode. This helps the driver easily recognize that any anomaly occurs, thereby preventing problems with the engine that would continue to operate abnormally.

In turn, if the operated state of the speed-fixing switch 23 is abnormal, the control unit 30 can be configured to prohibit the driving mode from switching to the speed-fixing mode. This helps the driver easily recognize that any anomaly occurs, thereby preventing problems with the speed-fixing switch 23 that would continue to be operated abnormally.

In some embodiments, the acceleration/deceleration fine adjustment switches 24, 25 are provided for finely adjusting the cruising speed when the boat cruises in the speed-fixing mode. This can offer the driver fine adjustments of the cruising speed to his/her desired speed.

The aforementioned embodiments are directed to some examples in which the speed-fixing mode can be achieved by controlling the throttle opening. However, the speed-fixing mode may also be achieved by controlling the engine speed or cruising speed.

Figure 7:
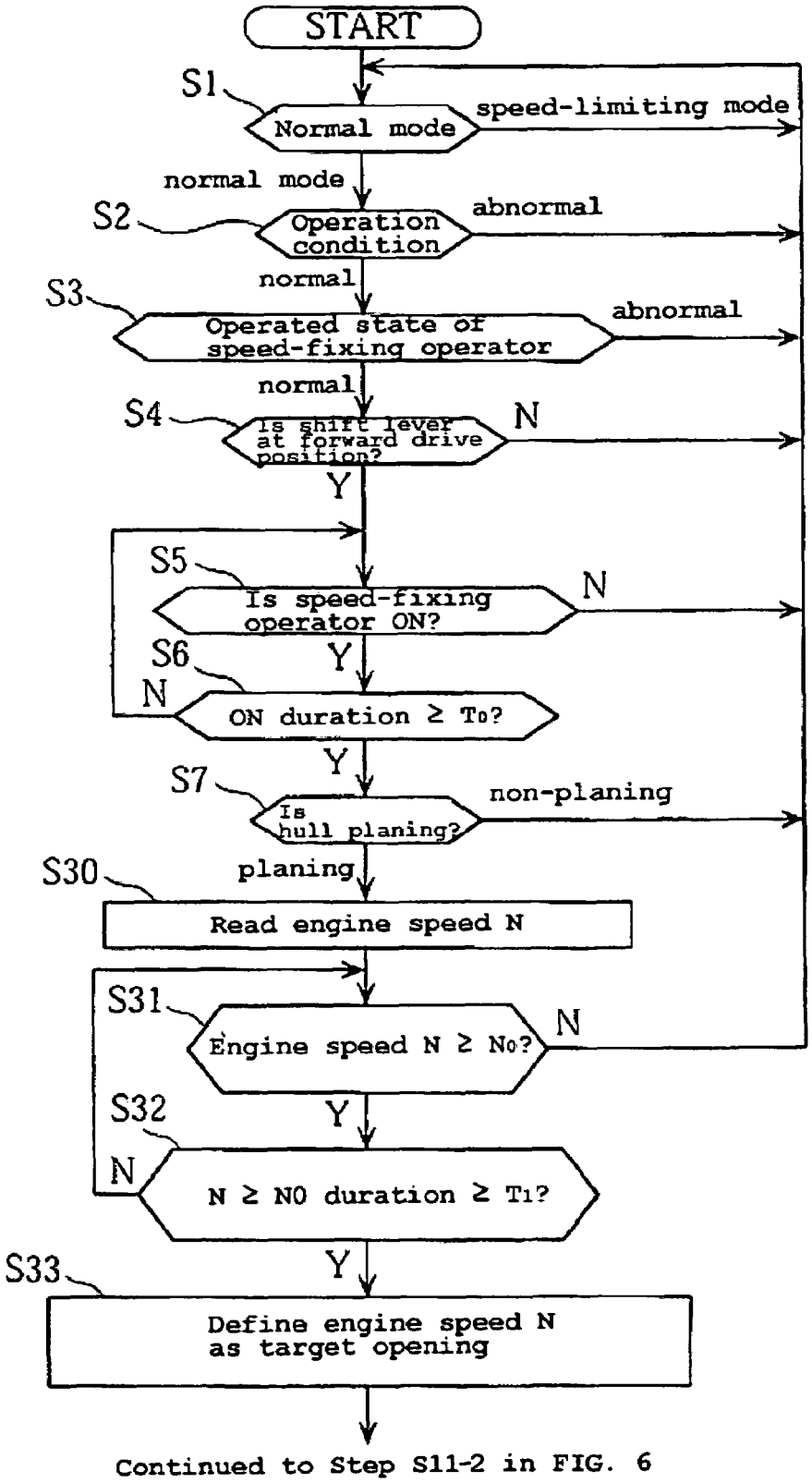
FIG. 7 is a flowchart for another control operation that can be used with the operation control system of FIG. 1.

FIG. 7 is a flowchart of another program for controlling the engine speed to achieve a speed-fixing mode. In FIG. 7, similar or equivalent parts are designated by the same numerals as in FIG. 5.

In the normal operation mode, if the engine operates normally, the speed-fixing switch can be operated normally, and the shift lever can be at the forward-drive position, then the speed-fixing switch can be turned ON. If the speed-fixing switch is kept ON for a certain time period $T_0$ or longer, the control unit judges that the driver has selected the automatic cruising, and determines whether or not the hull is at the stage of planing (steps S1 to S7).

If the hull is determined to be at the stage of planing, a current engine speed N can be read (step S30). A determination can be made whether or not the current engine speed N is equal to or greater than a preset value $N_0$. If the engine speed N is equal to or greater than $N_0$ and is kept for a certain time period $T_1$ or longer, this engine speed N can be defined as a target (steps S31 to S33). Thereby, the throttle opening can be controlled such that the engine speed reaches the target.

Figure 8:
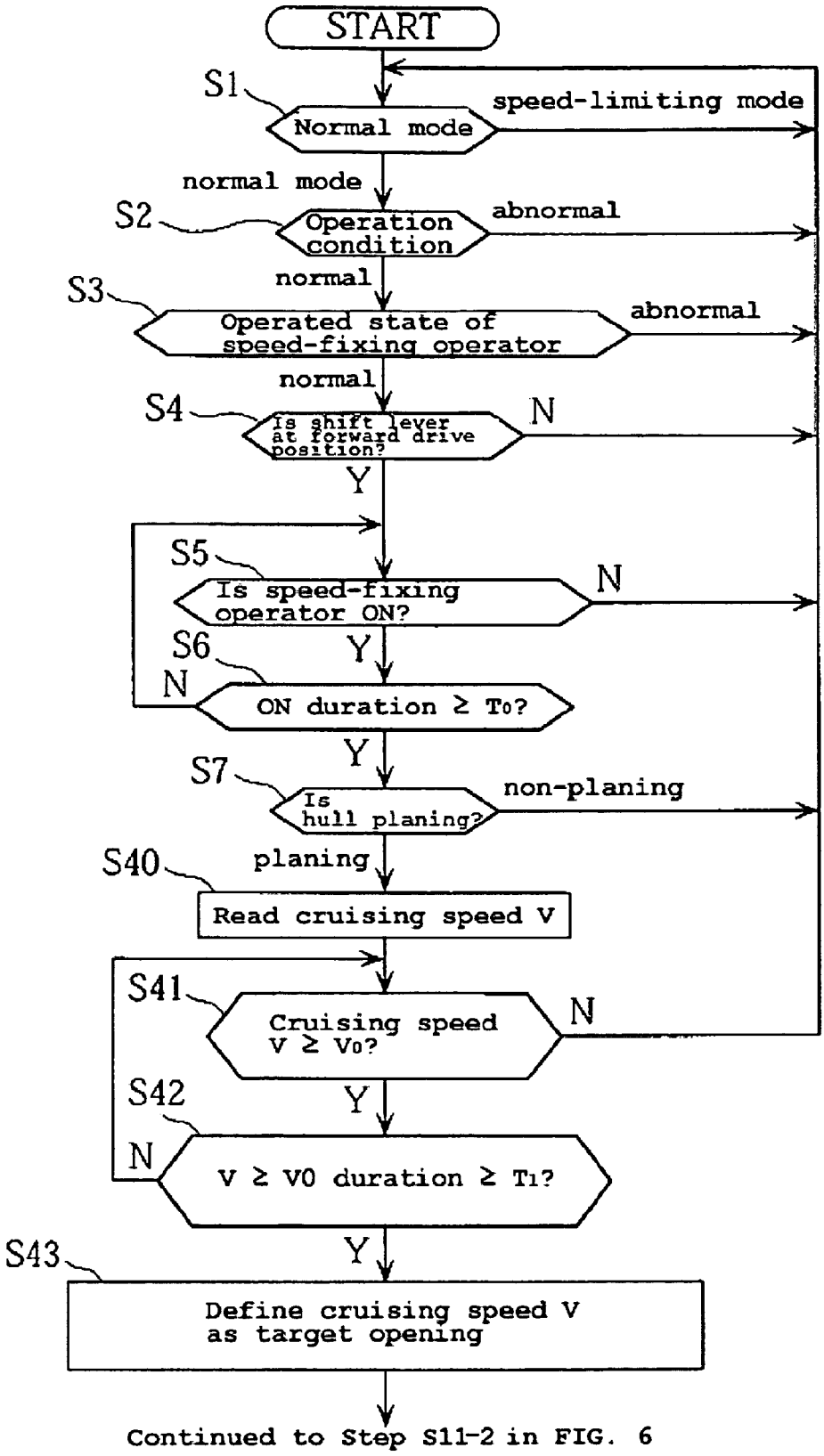
FIG. 8 is a flowchart for another control operation program that can be used with the operation control system of FIG. 1.
Figure 9:
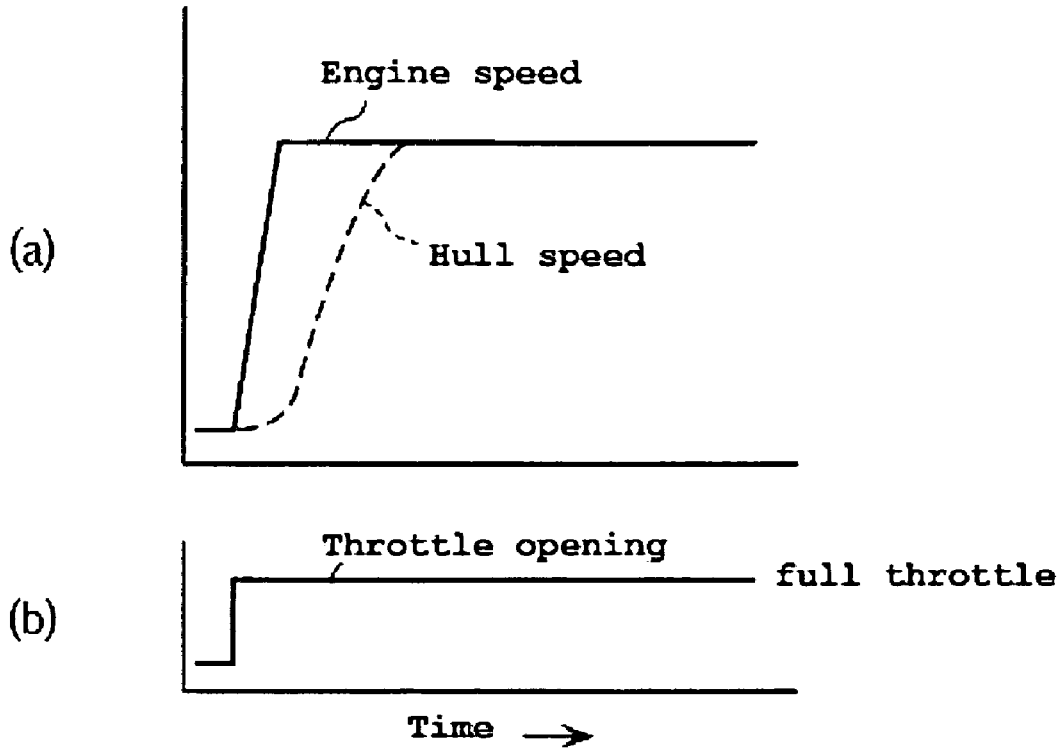
FIGS. 9(*a*) and 9(*b*) are schematic illustrations of maps for describing a process to practice the embodiments described herein.

FIG. 8 is a flowchart of a program for controlling the cruising speed to achieve the speed-fixing mode. In the figure, similar or equivalent parts are designated by the same numerals as in FIG. 5.

In the normal operation mode, if the engine operates normally, the speed-fixing switch is operated normally, and the shift lever is at the forward-drive position, then the speed-fixing switch is turned ON. If the speed-fixing switch is kept ON for a certain time period $T_0$ or longer, the control unit 30 determines that the driver has selected the automatic cruising, and determines whether or not the hull 2 is at the stage of planing (steps S1 to S7).

If the hull 2 is determined to be at the stage of planing, a current cruising speed V can be read (step S40). A determination can be made whether or not the cruising speed V is equal to or greater than a preset value $V_0$. If the cruising speed V is equal to or greater than $V_0$ and is kept for a certain time period $T_0$ or longer, this cruising speed V can be defined as a target (steps S41 to S43). Thereby, the throttle opening can be controlled such that the cruising speed reaches the target.

The speed-fixing mode is achieved by controlling the engine speed and the cruising speed in the manner as described, which also provides the same effects as those obtained in the aforementioned embodiments.

FIG. 8A illustrates some exemplary aural reports and other indicators that can be used with the watercraft 1. For example, as shown in FIG. 8A, when the watercraft 1 is switched from the normal operation mode to the speed fixing mode, for example, as is indicated in step S11-2 of FIG. 6, the aural reporting device 30*c* can be operated to issue three pulses. In the illustrated embodiment, each pulse has a duration of 0.05 seconds and each of those pulses are spaced from each other by 0.1 second of silence (e.g., off). Thus, in this embodiment, the buzzer will issue three short buzzer sounds when the control operation of FIG. 6 reaches step S11-2. As noted above, it is advantageous for the tone generated by the aural reporting device 30*c* to be of sufficient volume so that an operator of the watercraft 1 can hear the report while the watercraft 1 is at a planing speed.

Although the exemplary aural report described in cell 100 of the table of FIG. 8A includes three 0.5 second pulses, any other sound or buzzer pulse pattern can be used. However, further advantages are achieved where the report generated during the transition from the normal mode to the speed fixing mode is different from other sounds. This helps the operator understand what operation is being performed without having to further verify.

Optionally, as shown in cell 102 of the table of FIG. 8A, the display device 20 can also be configured to blink a light or other feature on the display device 20 when the watercraft 1 is switched from the normal operation mode to the speed fixing mode. For example, as described above with reference to FIGS. 1A and 1B, the speedometer 20*a* can be configured to blink (e.g., turn off then turn back on) the watercraft speed readout when the watercraft 1 is switched from the normal operating mode to the speed fixing mode. This provides a further indication for the operator that the mode has been changed.

With reference to cell 104 of the table of FIG. 8A, the watercraft 1 can be configured to activate the aural reporting device 30*c* when the target speed in the speed fixing mode is adjusted for either acceleration or deceleration. For example, but without limitation, during the steps S19 and/or S23 (FIG. 6), the aural reporting device 30*c* can be configured to issue a single pulse of sound when the operator chooses to either raise or lower the target watercraft speed. In the illustrated embodiment of the cell 104 of FIG. 8A, the single pulse sound has a duration of 0.1 seconds. However, this is merely an exemplary tone or sound that can be used for such an event. Other sounds, tones, or buzzer patterns can also be used.

With reference to cell 106 of the table of FIG. 8A, the display device 20 can also be configured to cause portions of the display device 20 to blink when the target speed is adjusted for acceleration or deceleration. For example, with reference to steps S19 and S23, when the operator either requests acceleration or deceleration in the speed fixing mode, the speedometer 20*a* can blink each time the user so requests. For example, the speedometer 20*a* can be configured to blink the three digit representation of the watercraft speed when the operator presses either of the adjustment buttons 24, 25. Optionally, the speedometer 20*a* can be configured to temporarily blink the target speed each time it is changed and then return to displaying the present watercraft speed. However, other blinking patterns can also be used. Optionally, the display 20 can be configured to continuously blink the representation of the target watercraft speed or the current watercraft speed at all times when the speed fixing mode is activated.

With reference to cell 108 of the table of FIG. 8A, the watercraft 1 can be configured to activate the aural reporting device 30*c* when the watercraft 1 is switched from the speed fixing mode to the normal operation mode. For example, and with reference to FIG. 6, this additional report can be issued during the step S24-1. In the illustrated embodiment, as shown in cell 108 of FIG. 8A, the aural reporting device 30*c* can be activated to issue two pulses, each lasting 0.1 seconds and spaced apart by a 0.1 second delay. However, other sounds, tones, or buzzer patterns can also be used.

With reference to cell 110 of the table of FIG. 8A, when the watercraft 1 is switched from the speed fixing mode to the normal operation mode, the display device 20 can be controlled to cancel the blinking activated in the cell 106. For example, as noted above, the speedometer 20*a* can be configured to continuously blink the target or present watercraft speed when the watercraft is operating in the speed fixing mode. Thus, when the watercraft 1 is switched from the speed fixing mode to the normal operation mode (for example, in step S24-2 of FIG. 6), the blinking of the speedometer 20*a* can be canceled. However, other indicators can also be used.

Finally, the aural reporting device 30*c* can be used for other indications. For example, where it is determined, for example, by the control unit 30, that maintenance is required for the watercraft 1, the aural reporting device 30*c* can be activated to issue another report. As shown in cell 112 of the table of FIG. 8A, the aural reporting device is activated to issue continuous pulses having a 0.5 second duration and a 0.5 second gap between each pulse. However, this is merely one exemplary buzzer pattern that can be used. Other tones, sounds, and buzzer patterns can also be used.

Further, with regard to the event causing this report, such an event can be any type of event for which maintenance may be required for the watercraft 1. For example, the control unit 30 may determine that the watercraft 1 is low on fuel, oil, other fluids, or other sensors or devices or actuators may be malfunctioning. Of course, the watercraft 1 can be configured to activate the aural reporting device 30*c* with different sounds, tones, or buzzer patterns with regard to each of these different events.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An operation control system for a planning-type boat comprising mode selection means for selecting a driving mode, the driving mode comprising at least one of a normal operation mode, in which the boat cruises at a speed in response to the displacement of an acceleration controller, and a speed-fixing mode in which the boat cruises at a fixed speed determined when a speed-fixing controller is operated, the system further comprising an aural reporting device configured to issue a first aural report when an operator inputs a command into the mode selection means, and planing condition determination means for determining whether a hull of the planning-type boat is at a stage of planing, wherein the mode selection means prohibits the driving mode from switching to the speed-fixing mode if the planing condition determination means determines that the hull is not at the stage of planing, and wherein the mode selection means permits the driving mode to switch to the speed-fixing mode if the planing condition determination means determines that the hull is at the stage of planing.

2. The operation control system for a planing boat according to claim 1, wherein the planing condition determination means determines that the hull is not at the stage of planing if an engine speed or cruising speed is kept lower than a preset value for a predetermined time period.

3. The operation control system for a planing boat according to claim 1, wherein the planing condition determination means determines that the hull is not at the stage of planing if a moving average obtained based on the engine speed is kept lower than a preset value for a predetermined time period.

4. The operation control system for a planing boat according to claim 1, wherein a speed-limiting mode is provided as an option to control the engine speed so as not to exceed the preset value, and the mode selection means permits the driving mode to switch to the speed-limiting mode if the normal operation mode has been selected, and the mode selection means prohibits the driving mode from switching to the speed-fixing mode if the speed-limiting mode has been selected.

5. An operation control system for a planning-type boat comprising mode selection means for selecting a driving mode, the driving mode comprising at least one of a normal operation mode, in which the boat cruises at a speed in response to the displacement of an acceleration controller, and a speed-fixing mode in which the boat cruises at a fixed speed determined when a speed-fixing controller is operated, the system further comprising an aural reporting device configured to issue a first aural report when an operator inputs a command into the mode selection means, wherein the mode selection means maintains the speed-fixing mode if the speed-fixing mode has been selected and if the displacement of the acceleration controller is equal to or greater than a preset value.

6. An operation control system for a planning-type boat comprising mode selection means for selecting a driving mode, the driving mode comprising at least one of a normal operation mode, in which the boat cruises at a speed in response to the displacement of an acceleration controller, a speed-fixing mode in which the boat cruises at a fixed speed determined when a speed-fixing controller is operated, the system further comprising an aural reporting device configured to issue a first aural report when an operator inputs a command into the mode selection means, and speed adjustment means for increasing/decreasing the cruising speed gradually by small degrees in accordance with inputs from a driver when the speed-fixing mode has been selected.

7. The operation control system for a planing boat according to claim 6, wherein the aural reporting device is configured to emit a second aural report when the issues an input into the speed adjustment means.

8. The operation control system for a planing boat according to claim 7, wherein the second aural report is different from the first aural report.

9. An operation control system for a planning-type boat comprising mode selection means for selecting a driving mode, the driving mode comprising at least one of a normal operation mode, in which the boat cruises at a speed in response to the displacement of an acceleration controller, and a speed-fixing mode in which the boat cruises at a fixed speed determined when a speed-fixing controller is operated, the system further comprising an aural reporting device configured to issue a first aural report when an operator inputs a command into the mode selection means, wherein the aural reporting device is configured to emit the first aural report when the operator switches the mode selection means to the speed-fixing mode from another mode.

10. An operation control system for a planning-type boat comprising mode selection means for selecting a driving mode, the driving mode comprising at least one of a normal operation mode, in which the boat cruises at a speed in response to the displacement of an acceleration controller, and a speed-fixing mode in which the boat cruises at a fixed speed determined when a speed-fixing controller is operated the system further comprising an aural reporting device configured to issue a first aural report when an operator inputs a command into the mode selection means, wherein the aural reporting device is configured to emit a second aural report when the operator switches the mode selection means form the speed-fixing mode to another mode, the second aural report being different from the first aural report.

11. An operation control system for a planing-type boat comprising a hull and an engine supported by the hull, the operation control system comprising an acceleration input device configured to be operable by a driver of the boat, a mode selection module configured to allow a driver of the boat to select a driving mode, the driving mode comprising at least one of a normal operation mode, in which the boat cruises at a speed in response to the displacement of the acceleration input device, and a speed- fixing mode in which the boat cruises at a fixed speed determined when a speed-fixing controller is operated, the system further comprising an aural reporting device configured to emit a first aural report when an input is issued to the mode selection module, and a planing condition determination module configured to determine whether the hull is at a stage of planing, wherein the mode selection module is also configured to prohibit the driving mode from switching to the speed-fixing mode if the planing condition determination module determines that the hull is not at the stage of planing, and wherein the mode selection module is configured to permit switching of the driving mode to the speed-fixing mode if the planing condition determination module determines that the hull is at the stage of planing.

12. The operation control system for a planing boat according to claim 11, wherein the planing condition determination module is configured to determine that the hull is not at the stage of planing if an engine speed or cruising speed is kept lower than a preset value for a predetermined time period.

13. The operation control system for a planing boat according to claim 11, wherein the planing condition determination module is configured to determine that the hull is not at the stage of planing if a moving average obtained based on the engine speed is kept lower than a preset value for a predetermined time period.

14. An operation control system for a planing-type boat comprising a hull and an engine supported by the hull, the operation control system comprising an acceleration input device configured to be operable by a driver of the boat, a mode selection module configured to allow a driver of the boat to select a driving mode, the driving mode comprising at least one of a normal operation mode, in which the boat cruises at a speed in response to the displacement of the acceleration input device, a speed-fixing mode in which the boat cruises at a fixed speed determined when a speed-fixing controller is operated, the system further comprising an aural reporting device configured to emit a first aural report when an input is issued to the mode selection module, and a speed adjustment module configured to increase and decrease the cruising speed gradually by small degrees, in accordance with input from a driver when the speed-fixing mode has been selected.

15. The operation control system for a planing boat according to claim 14, wherein the aural reporting device is configured to emit a second aural report when the issues an input into the speed adjustment module.

16. The operation control system for a planing boat according to claim 15,wherein the second aural report is different from the first aural report.

17. An operation control system for a planing-type boat comprising a hull and an engine supported by the hull, the operation control system comprising an acceleration input device configured to be operable by a driver of the boat, a mode selection module configured to allow a driver of the boat to select a driving mode, the driving mode comprising at least one of a normal operation mode, in which the boat cruises at a speed in response to the displacement of the acceleration input device, and a speed- fixing mode in which the boat cruises at a fixed speed determined when a speed-fixing controller is operated, the system further comprising an aural reporting device configured to emit a first aural report when an input is issued to the mode selection module, wherein the aural reporting device is configured to emit the first aural report when the operator switches the mode selection means to the speed-fixing mode from another mode.

18. The operation control system for a planing boat according to claim 17, wherein the aural reporting device is configured to emit a second aural report when the operator switches the mode selection means form the speed-fixing mode to another mode, the second aural report being different from the first aural report.

* * * * *

UNITED STATES PATENT AND TRADEMARK OFFICE

CERTIFICATE OF CORRECTION

PATENT NO. : 7,513,807 B2
APPLICATION NO. : 11/451904
DATED : April 7, 2009
INVENTOR(S) : Yoshimasa Kinoshita et al.

It is certified that error appears in the above-identified patent and that said Letters Patent is hereby corrected as shown below:

Title page, item [57] Abstract, Line 13, after “the stage of”, change “planning” to --planing--

In Column 1, Line 60, change “fill” to --full--

In Column 2, Line 50, change “speed fixing” to --speed-fixing--

In Column 2, Lines 57-58, change “speed fixing” to --speed-fixing--

In Column 2, Line 65, change “planning-type” to --planing-type--

In Column 3, Line 31, change “planning-type” to --planing-type--

In Column 3, Line 44, change “planning-type” to --planing-type--

In Column 5, Line 24, change “speed limiting” to --speed-limiting--

In Column 5, Line 29, change “speed limiting” to --speed-limiting--

In Column 7, Line 57, change “non-planning” to --non-planing--

In Column 9, Line 19, change “speed fixing” to --speed-fixing--

In Column 13, Line 17, change “thereof” to --thereof.--

In Column 13, Line 33, change “planning-type” to --planing-type--

In Column 14, Line 33, in Claim 7, change “the issues an input” to --an input is issued--

In Column 14, Line 57, in Claim 10, after “operated” insert --,--

In Column 14, Line 62, in Claim 10, change “form” to --from--

In Column 15, Line 6, in Claim 11, change “speed- fixing” to --speed-fixing--

In Column 16, Line 12, in Claim 15, change “the issues an input” to --an input is issued--

In Column 16, Line 15, in Claim 16, change “15,wherein” to --15, wherein--

In Column 16, Line 25, in Claim 17, change "speed- fixing" to --speed-fixing--

In Column 16, Line 36, in Claim 18, change "form" to --from--

Signed and Sealed this

Twentieth Day of April, 2010

David J. Kappos

David J. Kappos
*Director of the United States Patent and Trademark Office*